US011623858B2

(12) United States Patent
Fischer

(10) Patent No.: US 11,623,858 B2
(45) Date of Patent: Apr. 11, 2023

(54) METHOD FOR MANUFACTURING A COVER LAYER OF A FLEECE MATERIAL FOR AN INNERSPRING UNIT AND INNERSPRING UNIT

(71) Applicant: Spühl GmbH, Wittenbach (CH)

(72) Inventor: Andreas Fischer, Schwarzenbach (CH)

(73) Assignee: Spühl, GmbH, Wittenbach (CH)

( * ) Notice: Subject to any disclaimer, the term of this patent is extended or adjusted under 35 U.S.C. 154(b) by 44 days.

(21) Appl. No.: 17/689,297

(22) Filed: Mar. 8, 2022

(65) Prior Publication Data

US 2022/0185654 A1 Jun. 16, 2022

Related U.S. Application Data

(62) Division of application No. 16/620,013, filed as application No. PCT/EP2017/063836 on Jun. 7, 2017, now Pat. No. 11,299,391.

(51) Int. Cl.
*B68G 7/05* (2006.01)
*A47C 27/00* (2006.01)
(Continued)

(52) U.S. Cl.
CPC ..... *B68G 7/05* (2013.01); *A47C 27/002* (2013.01); *A47C 27/064* (2013.01); *B68G 7/02* (2013.01);
(Continued)

(58) Field of Classification Search
CPC ..... B68G 7/02; B68G 15/00; D01G 25/00; A47C 27/002
See application file for complete search history.

(56) References Cited

U.S. PATENT DOCUMENTS 2,335,642 A * 11/1943 Butler ..... D03D 15/233 139/426 R
2,757,436 A * 8/1956 Jonathan ..... D06C 23/00 139/420 R
(Continued)

FOREIGN PATENT DOCUMENTS

CN 1211409 A 3/1999
CN 1243802 A 2/2000
(Continued)

OTHER PUBLICATIONS

DE60003066T2 machine translation (Year: 2004).*
(Continued)

*Primary Examiner* — Michael W Hotchkiss
(74) *Attorney, Agent, or Firm* — Wood Herron & Evans LLP

(57) ABSTRACT

A cover layer of a fleece material for an innerspring unit comprising a plurality of pocketed springs is manufactured by supplying at least two longitudinal fleece webs, which extend substantially parallel in a longitudinal direction and are spaced from one another, and repeatedly attaching a transverse fleece web, which extends between the longitudinal fleece webs in a direction substantially perpendicular to the longitudinal direction, to the longitudinal fleece webs. The transverse fleece web segments are attached to the longitudinal fleece webs such that they form together with the longitudinal fleece webs a frame-like structure serving as the cover layer.

11 Claims, 9 Drawing Sheets

(51) Int. Cl.

| | |
|---|---|
| ***A47C 27/06*** | (2006.01) |
| ***B68G 7/02*** | (2006.01) |
| ***B68G 15/00*** | (2006.01) |
| ***B68G 9/00*** | (2006.01) |

(52) U.S. Cl.
CPC ..... *B68G 15/00* (2013.01); *B68G 15/005* (2013.01); *B68G 2009/005* (2013.01)

(56) References Cited

U.S. PATENT DOCUMENTS

| | | | | | |
|---|---|---|---|---|---|
| 2,808,596 | A * | 10/1957 | Schreiner | A47C 23/20 | 5/482 |
| 3,591,434 | A * | 7/1971 | Hartstein | D04H 3/04 | 428/114 |
| 3,949,111 | A * | 4/1976 | Pelletier | B29C 66/8322 | 156/181 |
| 4,097,631 | A * | 6/1978 | Wilken | A41D 31/00 | 428/196 |
| 4,170,676 | A * | 10/1979 | Thomas | B32B 5/14 | 428/113 |
| 6,098,968 | A * | 8/2000 | Workman | B68G 9/00 | 5/655.8 |
| 6,256,820 | B1 * | 7/2001 | Moser | A47C 27/064 | 5/721 |
| 6,295,676 | B1 * | 10/2001 | Warner | A47C 27/064 | 5/717 |
| 6,374,442 | B1 * | 4/2002 | Wells | A47C 27/063 | 5/655.8 |
| 6,425,969 | B1 * | 7/2002 | van den Akker | B29C 70/20 | 156/266 |
| 6,834,477 | B2 | 12/2004 | De Santis et al. | | |
| 6,904,855 | B2 * | 6/2005 | Xu | D05B 97/00 | 112/475.08 |
| 6,986,821 | B2 | 1/2006 | Van Den Aker | | |
| 7,264,023 | B2 * | 9/2007 | Jackson | D03D 15/00 | 139/420 R |
| 7,470,340 | B2 * | 12/2008 | Baldauf | D04H 13/00 | 156/244.11 |
| 7,877,964 | B2 | 2/2011 | Spinks et al. | | |
| 8,769,743 | B2 * | 7/2014 | Sanders | A47G 9/0207 | 5/500 |
| 11,047,073 | B2 * | 6/2021 | Wockatz | B32B 5/26 | |
| 2002/0116793 | A1 * | 8/2002 | Schmidt | D04H 13/00 | 19/296 |
| 2003/0070745 | A1 * | 4/2003 | Van Den Aker | D04H 3/12 | 156/178 |
| 2012/0149272 | A1 * | 6/2012 | Hergeth | D04H 1/74 | 264/103 |
| 2013/0198998 | A1 * | 8/2013 | Kuhn | D04H 1/74 | 19/163 |
| 2013/0247518 | A1 | 9/2013 | Spinks et al. | | |
| 2020/0172390 | A1 * | 6/2020 | Yao | B68G 7/02 | |

FOREIGN PATENT DOCUMENTS

| | | | | |
|---|---|---|---|---|
| CN | 1691909 | A | 11/2005 | |
| DE | 2147517 | A1 | 4/1973 | |
| DE | 292489 | A5 | 8/1991 | |
| DE | 19526972 | A1 | 1/1997 | |
| DE | 29710267 | U1 | 8/1997 | |
| DE | 60003066 | T2 * | 2/2004 | D04H 3/004 |
| DE | 102006049680 | A1 | 4/2008 | |
| DE | 202009001057 | U1 | 4/2009 | |
| EP | 1067090 | A1 | 1/2001 | |
| EP | 1226299 | B1 | 5/2003 | |
| EP | 1787551 | A1 | 5/2007 | |
| EP | 1595981 | B1 | 6/2007 | |
| EP | 1993947 | B1 | 3/2014 | |
| GB | 448275 | A | 6/1936 | |
| JP | H1112912 | A | 1/1999 | |
| WO | 2004060116 | A1 | 7/2004 | |

OTHER PUBLICATIONS

European Patent Office; Search Report and Written Opinnion in related International Patent Application No. PCT/EP2017/063836 dated Feb. 2, 2018; 14 pages.

* cited by examiner

METHOD FOR MANUFACTURING A COVER LAYER OF A FLEECE MATERIAL FOR AN INNERSPRING UNIT AND INNERSPRING UNIT

CROSS-REFERENCE TO RELATED APPLICATIONS

This application is a Divisional of U.S. patent application Ser. No. 16/620,013 filed Dec. 6, 2019 (pending), which is a U.S. National phase of International Patent Application Serial No. PCT/EP2017/063836 filed Jun. 7, 2017 (expired), the disclosures of which are incorporated by reference herein.

TECHNICAL BACKGROUND OF THE INVENTION

The present invention relates to a method and an apparatus for manufacturing a cover layer, which is made from a fleece material or a nonwoven fabric, for an innerspring unit comprising a plurality of pocketed or encased springs as well as a corresponding innerspring unit.

Innerspring units are typically used in innerspring mattresses. Conventional innerspring configurations include innerspring units in which coil springs are encased in welded pockets of a fabric material. Individual strings of such pocketed springs are connected by adhesive to one another so as to form an array of a plurality of pocketed springs arranged in rows and columns.

Such innerspring units may be manufactured by innerspring unit assembly machines which make innerspring units from endless strings of pocketed springs.

Conventional innerspring units also include cover layer at their top and bottom surfaces, which are made from a fleece material and are glued to the innerspring unit. However, the cover layers typically have an influence on the characteristics of the respective innerspring unit as the cover layers physically connect the individual springs at the top and bottom ends of the corresponding pockets of the innerspring unit so that the response of each spring is dependent on the surrounding or adjacent springs.

Therefore, it is an object of the present invention to provide a manufacturing method and a manufacturing apparatus, which allow to manufacture a cover layer for an innerspring unit having a design such that the response of at least most of the individual springs of the innerspring unit is independent from the adjacent springs once the cover layer has been attached to the innerspring unit. In particular, it is an object of the present invention to provide a manufacturing method and a manufacturing apparatus for the manufacture of a cover layer for an innerspring unit, which allow to produce the cover layer with a reduced amount of fleece material in a fully automated process, thereby reducing the manufacturing cost as well. Finally, it is also an object of the invention to provide an improved innerspring unit having the aforesaid characteristics.

BRIEF SUMMARY OF THE INVENTION

According to an embodiment of the invention, a method of manufacturing a cover layer made from a fleece material for an innerspring unit is provided, which comprises supplying at least two longitudinal fleece webs, which extend substantially parallel in a longitudinal direction and are spaced from one another; and repeatedly attaching a transverse fleece web, which extends between the longitudinal fleece webs in a direction substantially perpendicular to the longitudinal direction, to the longitudinal fleece webs, the transverse fleece webs attached to the longitudinal fleece webs forming together with the longitudinal fleece webs a frame-like structure serving as the cover layer.

The longitudinal fleece webs may be supplied as endless longitudinal fleece webs, and by repeatedly cutting the longitudinal fleece webs a frame-like structure may be obtained, which is formed by two segments of the two longitudinal fleece webs and two successive transverse fleece webs attached to the two segments of the longitudinal fleece webs.

The step of attaching the transverse fleece web may comprise welding the transverse fleece web to each of the longitudinal fleece webs.

According to a further embodiment of the invention, the step of repeatedly attaching a transverse fleece web to the longitudinal fleece webs is carried out while the longitudinal fleece webs are conveyed in the longitudinal direction by a respective conveying device. Furthermore, the step of repeatedly attaching a transverse fleece web may comprises holding the transverse fleece web with a holding device and positioning the transverse fleece web with the holding device at the longitudinal fleece webs, attaching the transverse fleece web adjacent to a first transverse edge of the transverse fleece web to the longitudinal fleece webs, releasing the holding device so that the transverse fleece web attached to the longitudinal fleece webs is conveyed together with the longitudinal fleece webs, cutting the transverse fleece web to a desired width in the longitudinal direction to obtain a second transverse edge of the transverse fleece web, and attaching the transverse fleece web adjacent to the second transverse edge to the longitudinal fleece webs.

The method may further comprise supplying a fleece material from a storage device and repeatedly cutting the fleece material to obtain the transverse fleece web.

The method may be performed as a fully automated process in an innerspring unit assembly machine and may in particular be part of a method for manufacturing an innerspring unit comprising a plurality of pocketed springs, in which the cover layer is attached to a surface of a body comprising a plurality of pocketed springs.

According to an embodiment, the manufacturing of the cover layer may be carried out at a first automated station of an innerspring unit assembly machine, while the attaching of the cover layer to the body comprising the plurality of pocketed springs may be carried out at a second automated station of the innerspring unit assembly machine. The first and second automated stations may be located apart from each other, and a conveying device may be provided for conveying the cover layer by conveying the longitudinal fleece webs from the first station to the second station.

The innerspring unit may be manufactured by manufacturing a first cover layer and a second cover layer and attaching the first cover layer to a top surface of the body comprising the plurality of pocketed springs and the second cover layer to a bottom surface of the body comprising the plurality of pocketed springs.

According to a further embodiment of the invention, the cover layer of the fleece material is manufactured as the frame-like structure comprising a closed edge area where fleece material of the longitudinal fleece webs or fleece material of the transverse fleece webs is present and a middle area surrounded by the edge area, where no fleece material is present.

By omitting fleece material in the middle of the cover layer and in the middle of the corresponding innerspring unit, the response of the individual pocketed springs at least in the middle area of the innerspring unit is independent of the adjacent or surrounding pocketed springs. In addition, fleece material can be saved, thereby reducing the manufacturing cost of the cover layer and of the innerspring unit.

According to alternative embodiments of the invention, the frame-like structure may be provided for only one of the two cover layers, while the respective other cover layer may include the fleece material over its entire area. In addition, the frame-like structure may comprise one or more additional transverse fleece connections between the longitudinal fleece webs.

According to another embodiment of the invention, the longitudinal fleece webs and the transverse fleece webs are attached to each other to form a semi-finished fleece product which is then transported to the core or the body of the innerspring unit, where it can be positioned above or underneath the body of the innerspring unit and attached thereto.

In order to allow a fully automated implementation of the method, according to a further embodiment, the longitudinal fleece webs are used to transport the semi-finished fleece product to the station where it can be attached or glued to the body of the innerspring unit. Preferably, the transverse webs are attached to the longitudinal webs as close as possible to the place where the semi-finished fleece product is attached to the body of the innerspring unit, so as to reduce the risk that, during the transport of the semi-finished fleece product, wrinkles are formed in the fleece webs or the fleece webs are deflected out of the conveying direction. This risk is also minimized by the use of the longitudinal fleece webs as conveyor means for the transverse webs.

According to a further embodiment, an apparatus for manufacturing a cover layer of a fleece material for an innerspring unit is provided, which comprises a supply device for supplying at least two longitudinal fleece webs such that they extend substantially parallel in a longitudinal direction and are spaced from one another, and an attachment device for repeatedly attaching a transverse fleece web, which extends between the longitudinal fleece webs in a direction substantially perpendicular to the longitudinal direction, to the longitudinal fleece webs. The transverse fleece webs attached to the longitudinal fleece webs form together with the longitudinal fleece webs a frame-like structure serving as the cover layer.

The supply device may be configured to supply the longitudinal fleece webs as endless longitudinal fleece webs, and the apparatus may further comprise a cutting device for repeatedly cutting the longitudinal fleece webs to repeatedly obtain a frame-like structure formed by two segments of the two longitudinal fleece webs and two successive transverse fleece webs attached to the two segments of the longitudinal fleece webs.

According to a further embodiment, the attachment device may comprise a welding device for welding the transverse fleece web to each of the longitudinal fleece webs.

In addition, the attachment device may comprise a holding device for holding the transverse fleece web and positioning the transverse fleece web with the holding device at the longitudinal fleece webs, an attachment unit for attaching the transverse fleece web in an area adjacent to a first transverse edge of the transverse fleece web to the longitudinal fleece webs, a control unit for releasing the holding device so that the transverse fleece web attached to the longitudinal fleece webs is conveyed together with the longitudinal fleece webs, and a cutting device for cutting the transverse fleece web to a desired width in the longitudinal direction to obtain a second transverse edge of the transverse fleece web. The attachment unit may also be configured to attach the transverse fleece web in an area adjacent to the second transverse edge to the longitudinal fleece webs.

According to another embodiment, a conveyor device may be provided for conveying the longitudinal fleece webs in the longitudinal direction, and the attachment device may be configured to repeatedly attach a transverse fleece web to the longitudinal fleece webs while the longitudinal fleece webs are conveyed by the respective conveying device.

The apparatus may also comprise a storage device for supplying a fleece material, and a cutting device may be provided for repeatedly cutting the fleece material to obtain the transverse fleece webs or segments.

According to an embodiment, a control unit is provided to control the apparatus to manufacture the cover layer in a fully automated process, so that the control unit correspondingly controls and coordinates the functionalities of the individual components of the apparatus which may be part of an innerspring unit assembly machine.

According to a further embodiment, an innerspring unit is provided, which comprises a body or core comprising a plurality of pocketed springs, and at least one cover layer of a fleece material attached to a surface of the body comprising the plurality of springs, wherein the cover layer of the fleece material is manufactured as a frame-like structure comprising a closed edge area where the fleece material is present and a middle area surrounded by the edge area where no fleece material is present.

A first cover layer may be attached to a top surface of the body comprising the plurality of springs, while a second cover layer may be attached to a bottom surface of the body comprising the plurality of springs.

According to a further embodiment, the innerspring unit may be manufactured by the method and the apparatus according to the aforesaid embodiments.

In the following, embodiments of the invention will be described in detail with reference to the accompanying drawings.

DETAILED DESCRIPTION OF THE DRAWINGS

Figure 1B:
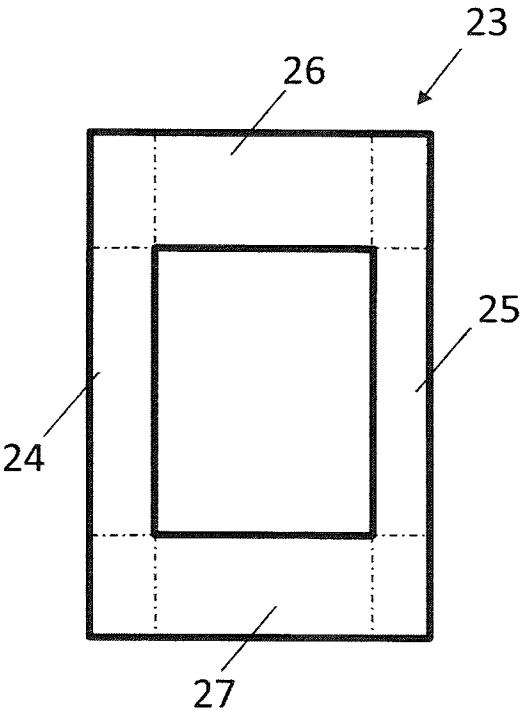
FIGS. 1A and 1B shows a plan view of an innerspring unit and of a cover layer of the innerspring unit according to an embodiment of the invention.
Figure 1A:
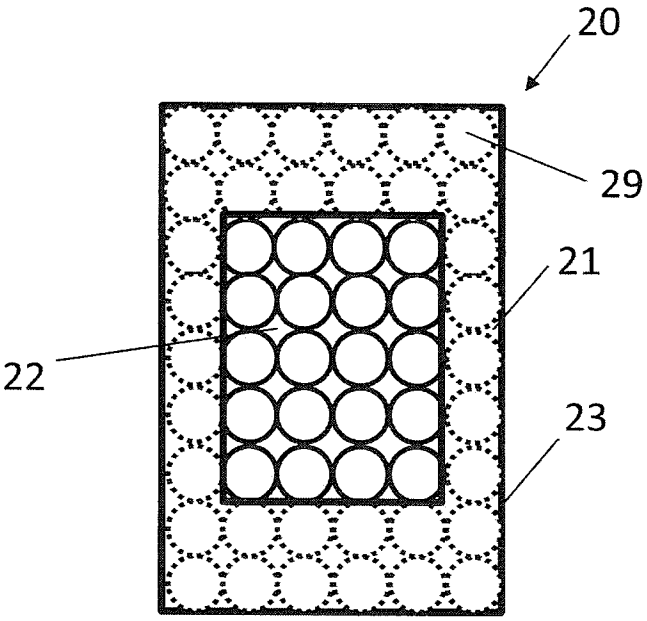

FIGS. 1A and 1B shows a plan view of an innerspring unit and of a cover layer of the innerspring unit according to an embodiment of the invention.

The innerspring unit 20 shown in FIG. 1A comprises a body or a core of a plurality of pocketed springs 29. In more detail, the body of the innerspring unit 20 is manufactured from an endless row of pocketed springs 29 from which individual strings of pocketed springs 29 are cut and attached or glued to one another so as to form the body shown in FIG. 1A in which the individual springs 29 are arranged in an array of rows and columns. In the embodiment shown in FIG. 1A, the body comprising the plurality of springs 29 is covered by a cover layer 23 which is made from a fleece or nonwoven material. In the embodiment shown in FIG. 1A, the cover layer 23 is attached or glued to the upper surface of the body having the plurality of springs 29, and in particular the cover layer 23 has a frame-like structure with an edge area 21 where fleece material is present and a middle area 22 when no fleece material is present. In other words, in the middle area 22, the corresponding springs of the body of the innerspring unit 20 are not covered by the material of the cover layer 23, so that at least in this area the response of the individual springs is independent of the adjacent or surrounding springs as the pockets of the springs are not connected by the cover layer 23.

FIG. 1B shows a plan view of the cover layer 23 of FIG. 1A. As indicated in FIG. 1B, the frame-like structure 21 of the cover layer 23 is formed by two longitudinal fleece web segments 24, 25 and two transverse fleece web segments 26, 27. In particular, in the embodiment of FIG. 1B, the transverse fleece web segments 26, 27 are attached, preferably welded, to the longitudinal fleece webs or segments 24, 25 to form the frame-like structure of the cover layer 23.

Although not shown in FIGS. 1A and 1B, according to a preferred embodiment, a cover layer 23 of the type shown in FIGS. 1A and 1B may be attached to each of the top and bottom surfaces of the innerspring unit 20, so that the strings of the pocketed springs 29 are sandwiched between the pair of cover layers 23.

Figure 2:
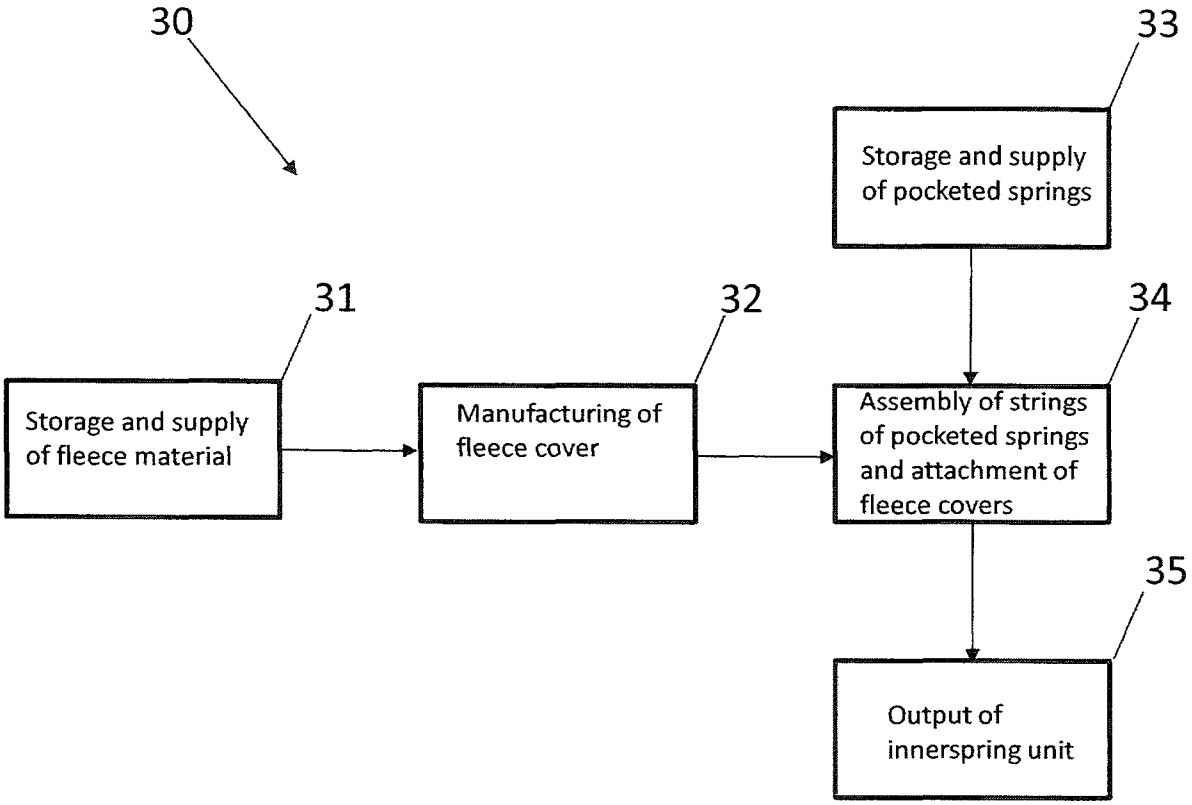
FIG. 2 is a schematic view of an innerspring unit assembly machine according to an embodiment of the invention.

FIG. 2 shows a schematic view of an innerspring unit assembly machine 30 which may be configured to assemble and manufacture the innerspring unit of FIG. 1.

The innerspring unit assembly machine 30 shown in FIG. 2 comprises a device 31 for the storage and supply of fleece material. As will be discussed below in more detail, the storage and supply device 31 may comprise a separate device for the supply of longitudinal fleece webs and a separate device for the supply of transverse fleece webs.

The fleece webs provided by the storage and supply device 31 are supplied to an apparatus 32 for the manufacturing of a fleece cover layer, for example the fleece cover layer 23 shown in FIGS. 1A and 1B. The apparatus 32 is configured such that it attaches the transverse fleece webs to the longitudinal fleece webs to obtain the cover layer 23 made from the fleece material and having the frame-like structure shown in FIGS. 1A and 1B.

The cover layer thus manufactured by the manufacturing apparatus 32 is supplied to a station 34 which in addition receives pocketed springs from a pocketed spring storage and supply device 33. In particular, the pocketed spring storage and supply device 33 may provide an endless row of pocketed springs to the station 34 where the endless row of pocketed springs is cut into individual strings of pocketed springs which are then assembled to an innerspring unit, e.g., an innerspring unit 20 of the type shown in FIG. 1A. Furthermore, the station 34 is configured and designed to attach to the top and/or bottom surfaces of the innerspring unit cover layers which have been manufactured by the manufacturing apparatus 32.

The innerspring unit thus assembled and manufactured by the station 34 is output at 35 as the final product of the innerspring unit assembly machine 30.

The innerspring unit assembly machine 30 manufactures the innerspring unit in a fully automated process. The operation of each of the stations 31 to 35 of the innerspring unit assembly machine 30 is computer-controlled and coordinated by one or more control units.

Figure 3:
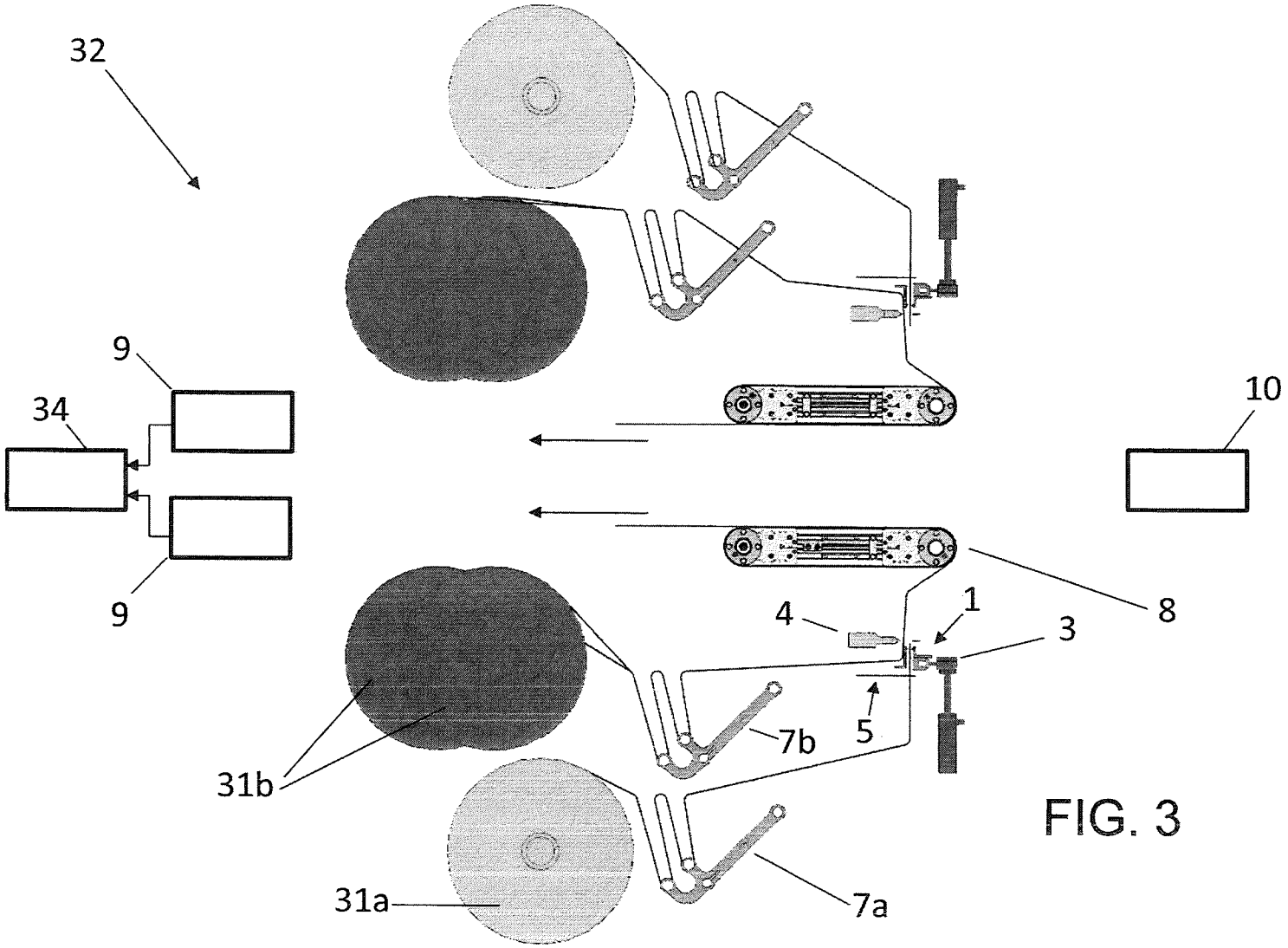
FIG. 3 shows an apparatus for manufacturing a cover layer for an innerspring unit according to an embodiment of the invention.

FIG. 3 shows an embodiment of the fleece cover layer manufacturing apparatus 32 of FIG. 2.

The fleece cover layer manufacturing apparatus 32 has a section for the manufacturing of a top fleece cover layer and a separate section for the manufacturing of a bottom fleece cover layer. The structure and the functionality of both manufacturing sections are substantially similar, so that in the following only the configuration of the lower section for the manufacturing of the lower fleece cover layer will be described, which however likewise applies to the configuration of the upper section for the manufacturing of the upper fleece cover layer.

As indicated in FIG. 3, a supply device 31*a* is provided for supplying a transverse fleece web, and separate supply devices 31*b* are provided for supplying at least two longitudinal fleece webs (for example, the longitudinal fleece webs 24 and 25 shown in FIGS. 1B and 1*n* FIGS. 5A-5F). The two longitudinal fleece webs are provided to extend substantially parallel and spaced apart from each other to form the two longitudinal sides of the cover layer of the innerspring unit. The transverse fleece web is provided to form the transverse fleece segments of the cover layer of the innerspring unit. The two longitudinal fleece webs are each supplied and provided as an endless fleece web which is conveyed by a conveying device 8 in a direction indicated by an arrow in FIG. 3. Both the two longitudinal fleece webs and the transverse fleece web are guided along a series of rollers 7*a*, 7*b* which correspondingly change the direction of the respective fleece web such that the transverse fleece web can be positioned at the two longitudinal fleece webs and attached thereto by means of an attachment device.

As also indicated in FIG. 3, the attachment device may comprise a holding device 1-3 for clamping and holding the transverse fleece web, a welding device 4 acting as an attachment unit for attaching or welding the transverse fleece web to the two longitudinal fleece webs, and a cutting device 5 to cut the transverse fleece web into corresponding transverse fleece web segments.

As will be discussed in the following in more detail, the attachment device shown in FIG. 3 is configured such that segments of the transverse fleece web are repeatedly attached to the two longitudinal fleece webs, so that an endless semifinished fleece product is created which is then conveyed by means of the conveying device 8 to the assembly station 34 shown in FIG. 2 where the individual frame-like cover layers 33 are cut from this semi-finished fleece product by means of cutting devices 9 which cut the longitudinal fleece webs at appropriate positions to obtain the frame-like cover layer 23 (in FIG. 3, separate cutting devices 9 are depicted for the cutting of the semi-finished fleece product of the top cover layer and for the cutting of the semi-finished fleece product of the bottom cover layer, respectively). In other words, the longitudinal fleece webs are used to transport the transverse fleece web segments, which have been attached thereto by means of the attachment device described above, to the assembly station 34 shown in FIG. 2.

The operation of the attachment device shown in FIG. 3 will now be described in more detail with reference to FIGS. 4A and 4B.

Figure 4A:
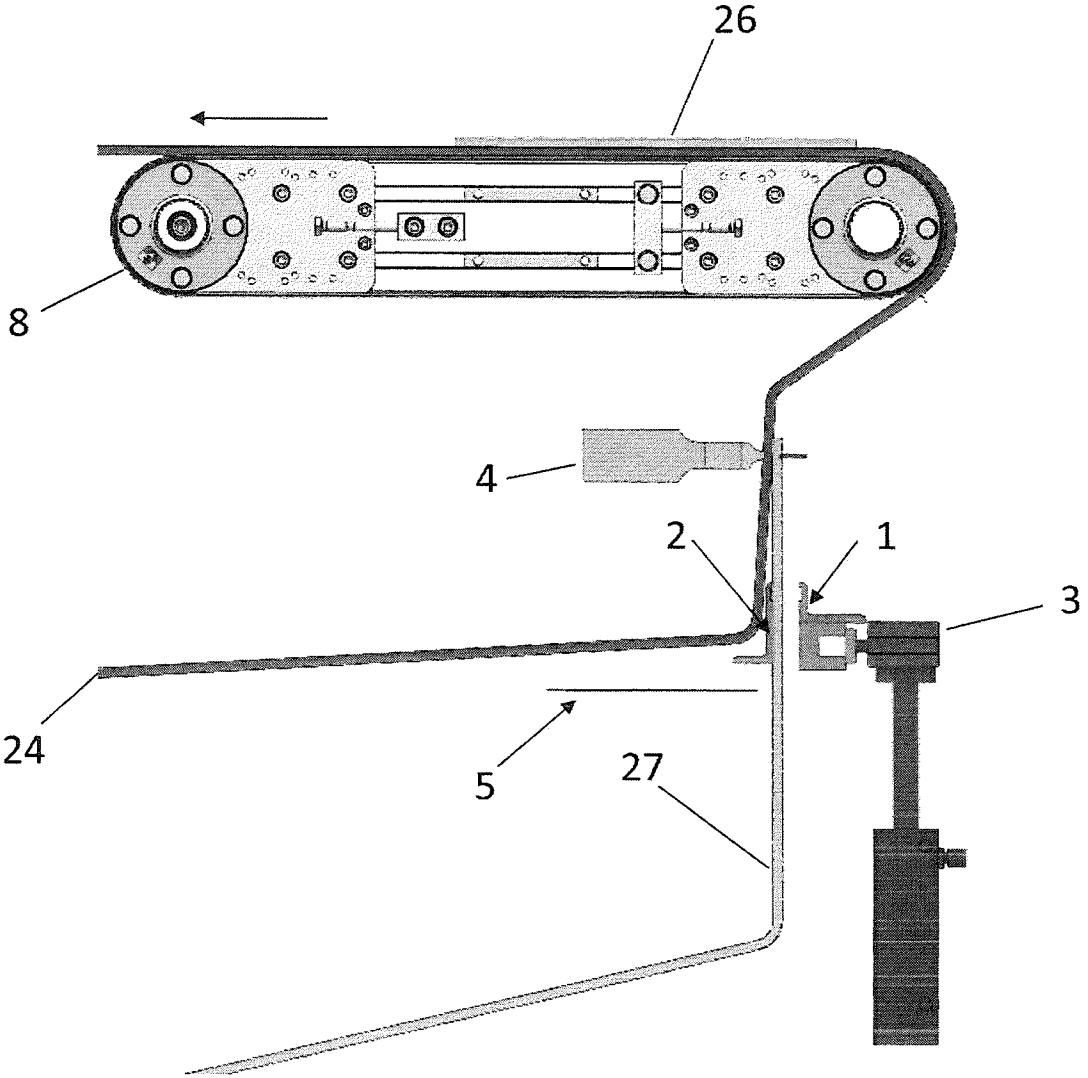
FIGS. 4A and 4B illustrate the functionality of the manufacturing apparatus of FIG. 3.
Figure 4B:
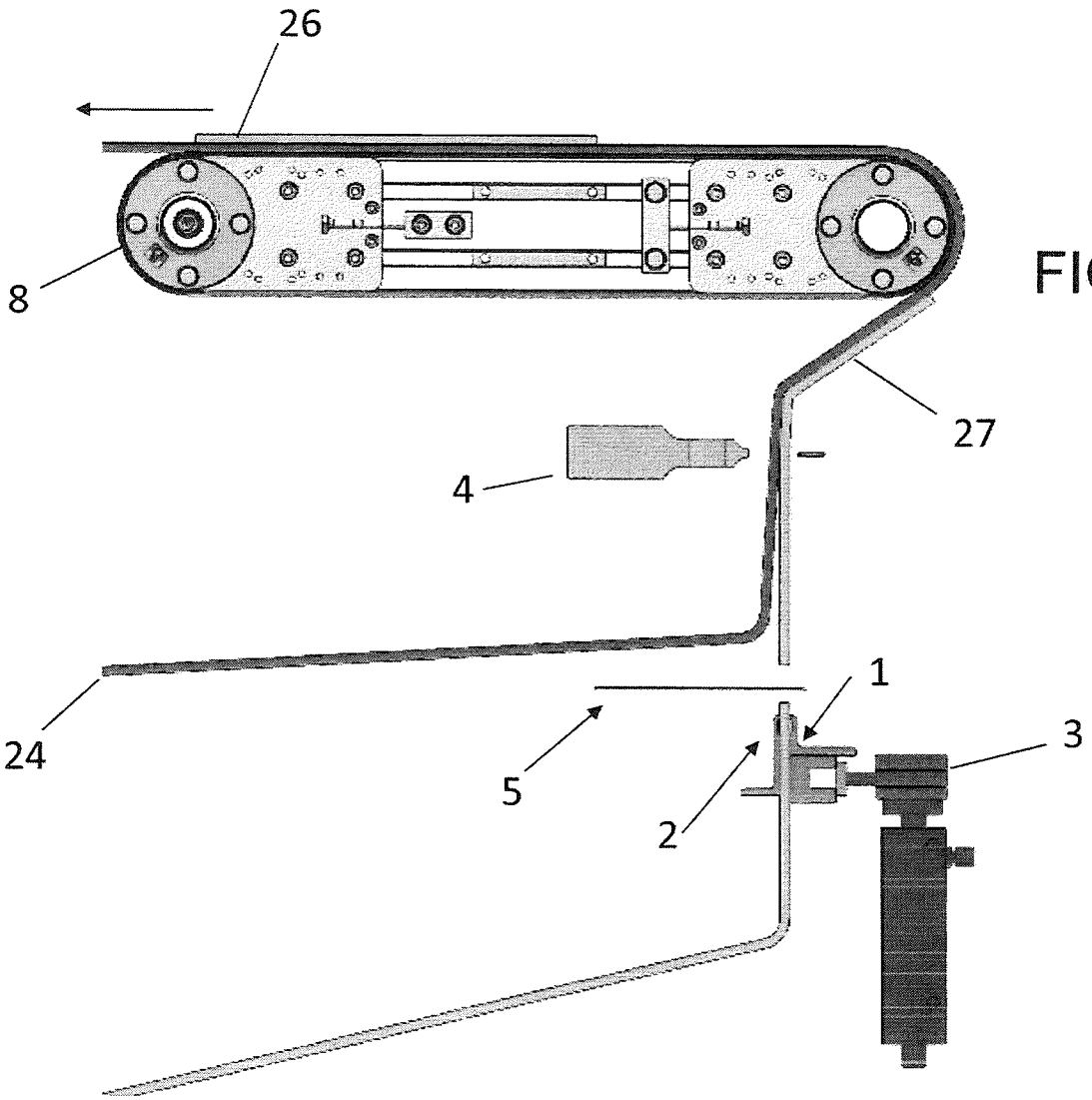

In FIGS. 4A and 4B, it is assumed that the transverse web segment 27 of the frame-like cover layer 23 shown in FIG.

1B is manufactured and attached to the longitudinal fleece webs 24, 25. Furthermore, in FIGS. 4A and 4B, it is assumed that the transverse web segment 26 of FIG. 1B has already been attached to the longitudinal fleece webs 24, 25 and is conveyed together with the longitudinal fleece webs 24, 25 by means of the conveying device 8 in the direction indicated by an arrow. As FIGS. 4A and 4B are side views, only the longitudinal fleece web 24 is depicted.

In the embodiment shown in FIGS. 4A and 4B, the holding device comprises a moveable clamping unit 1, an L-shaped profile 2 and a clamping cylinder 3. The clamping cylinder 3 activates the clamping unit 1 to selectively press it against the L-shaped profile 2 to clamp the transverse fleece web therebetween or to move it away from the L-shaped profile 2 to release the transverse fleece web. The holding device 1-3 is provided to hold and clamp the transverse fleece web and to arrange it at a desired position with respect to the longitudinal fleece webs 24, 25. As indicated in FIG. 4A, the L-shaped profile 2 is arranged between the transverse fleece web 27 and the longitudinal fleece webs 24, 25. Preferably, the holding device 1-3 is configured to clamp the transverse fleece web 27 over its entire width, the width direction being perpendicular to the drawing plane of FIGS. 4A and 4B.

FIG. 4A shows a state in which a front edge of the transverse fleece web 27 has already been positioned by means of the holding device 1-3 at an appropriate position with respect to the longitudinal fleece web 24 (and the parallel longitudinal fleece web 25) and welded to the longitudinal fleece webs by means of the welding device 4. Since the front edge of the transverse fleece web 27 has been attached to the longitudinal fleece webs 24, 25, the clamping cylinder 3 is operated to release the clamping unit 1 from the L-shaped profile 2, as indicated in FIG. 4 A, and the holding device 1-3 can return to its starting position by moving the clamping cylinder 3 downwards. In this state, the transverse fleece web 27 is no longer held or clamped by the holding device 1-3, so that the transverse fleece web 27 will be drawn by the longitudinal fleece webs 24, 25 due to the attachment of its front edge to the longitudinal fleece webs in the conveying direction of the longitudinal fleece webs.

When the transverse fleece web 27 has reached a desired position with respect to the longitudinal fleece webs 24, 25, which corresponds to a desired width of the transverse fleece web 27 in the conveying direction of the transverse webs 24, 25, the cutting device 5 is operated to cut the transverse fleece web 27 to the desired width.

FIG. 4B shows the state in which the cutting device 5 cuts the transverse fleece web to obtain the desired segment 27 of the transverse fleece web segment. Furthermore, FIG. 4B also shows that in this state the holding device 1-3 is again operated to clamp the front edge of the remaining transverse fleece web so as to avoid that the transverse fleece web gets lost. As the holding device 1-3 clamps the front edge of the remaining transverse fleece web, in a subsequent operating step this front edge can then be positioned again at the longitudinal fleece webs 24, 25 by moving the clamping cylinder 3 upwards and attached thereto as shown in FIG. 4A.

In the state shown in FIG. 4B, the rear edge of the transverse fleece web segment 27 has not yet been fixed to the longitudinal fleece webs 24, 25. As explained above, the transverse fleece web segment 27 is conveyed together with the longitudinal fleece webs 24, 25 in the arrow direction indicated in FIG. 4B. When the free rear edge of the transverse fleece web segment 27 reaches the position where the welding unit 4 is located, the rear edge of the transverse fleece web segment 27 is welded by means of the wedding unit 4 to the longitudinal fleece webs 24, 25, so that ultimately the transverse fleece web segment 27 is attached to the longitudinal fleece webs 24, 25 both at its front edge and at its rear edge.

The transverse fleece web segments 26, 27 shown in FIG. 4B form together with the longitudinal fleece webs 24, 25 the semi-finished fleece product which is then cut by the cutting device 9 shown in FIG. 3 into the frame-like structure of the cover layer 23 of FIGS. 1A and 1B. The cutting device 9 cuts the longitudinal fleece webs 24, 25 at appropriate positions so as to obtain the structure of the cover layer 23 shown in FIGS. 1A and 1B.

The manufacturing method performed by the manufacturing apparatus 32 shown in FIGS. 3 and 4 is completely automated and to this end controlled by one or more control units, for example the control unit 10 shown in FIG. 3, which coordinate the operation of the individual components of the manufacturing apparatus 32. In particular, the operation of the individual components of the manufacturing apparatus 32 preferably is also coordinated with the operation of the other components of the innerspring unit assembly machine 30 depicted in FIG. 2, so that the entire innerspring unit can be manufactured in a fully automated process.

The operation and functionality of the attachment device of the manufacturing apparatus 32 will now also be illustrated with respect to FIGS. 5A-5F. FIGS. 5A-5F show plan views of the longitudinal fleece webs 24, 25 during different states or steps of the attachment of the transverse fleece web 27 to the longitudinal fleece webs 24, 25. The conveying direction/running direction of the longitudinal fleece webs 24, 25 is indicated by arrows in FIGS. 5A-5F, so that the longitudinal fleece webs 24, 25 are conveyed in FIGS. 5A-5F from right to left. Furthermore, in FIGS. 5A-5F, the position of the welding unit 4 or its welding head with respect to the transverse fleece web 27 is indicated by WH, while the position of the cutting unit 5 is indicated by C.

Figure 5A:
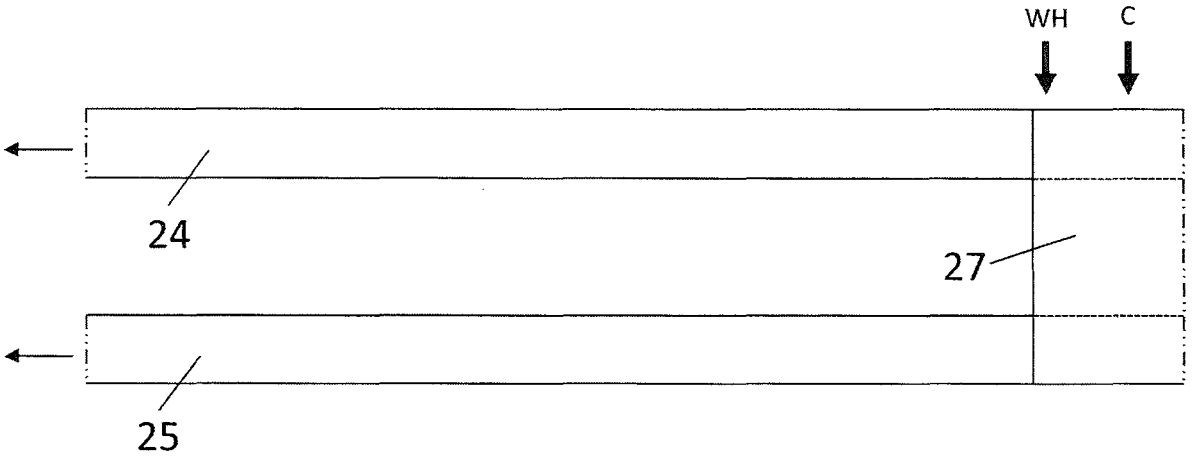
FIGS. 5A-5F show a method of manufacturing a cover layer for an innerspring unit according to an embodiment of the invention.

FIG. 5A shows a state in which the front edge of the transverse fleece web 27 is clamped by the holding device 1-3 and is positioned at the longitudinal fleece webs 24, 25, similar to the state shown in FIG. 4A.

Figure 5B:
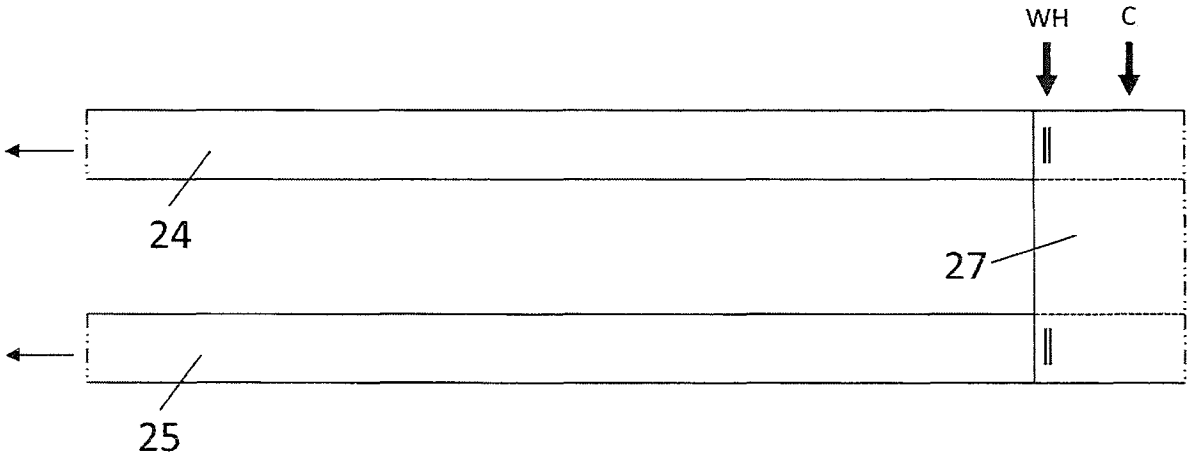

When the front edge of the transverse fleece web 27 reaches the position WH of the welding unit 4, the welding unit 4 is operated to weld the front edge of the transverse fleece web 27 to both longitudinal fleece webs 24, 25, as shown in FIG. 5B.

Thereafter, as explained above, the holding device 1-3 is opened to release the transverse fleece web 27, so that the transverse fleece web 27 can be conveyed along with the longitudinal fleece webs 24, 25 due to the attachment of its front edge to the longitudinal fleece webs 24, 25. In other words, the transverse fleece web 27 is drawn at its front edge by the longitudinal fleece webs 24, 25 in the conveying direction.

Figure 5C:
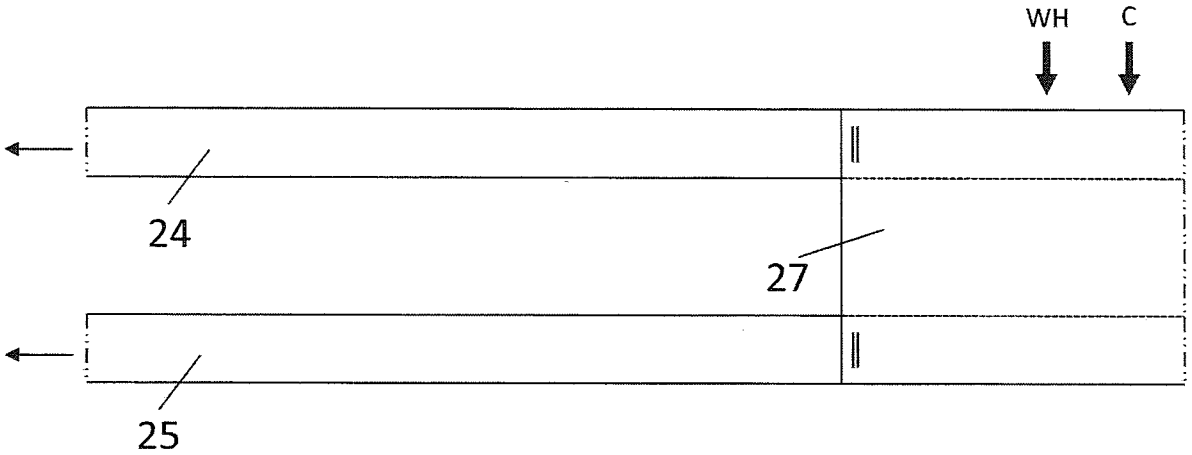

FIG. 5C shows a state in which the transverse fleece web 27 has already been conveyed to some extent by the longitudinal fleece webs 24, 25 in the conveying direction.

Figure 5D:
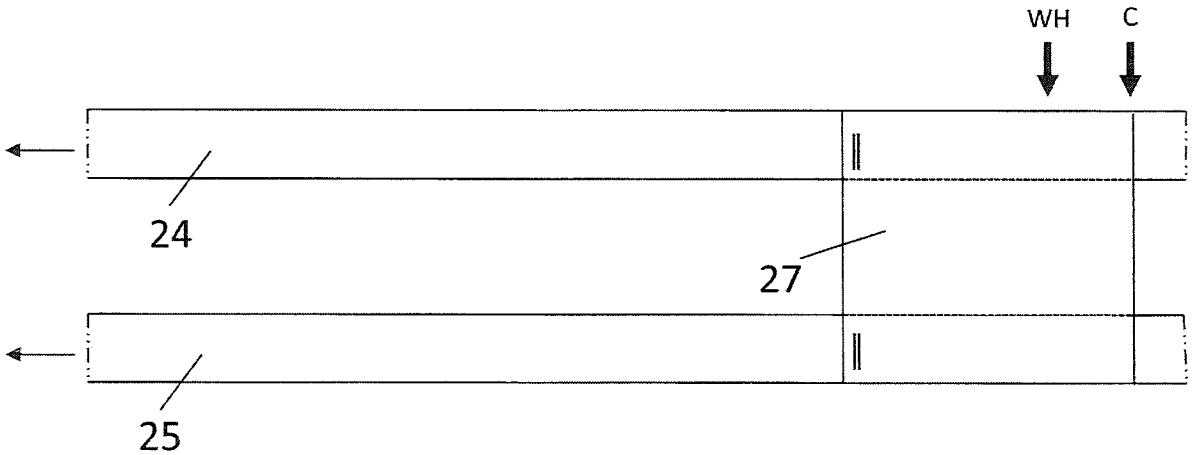

When the transverse fleece web 27 has reached a predetermined position with respect to the cutting device 5, which corresponds to a desired width of the transverse fleece web 27 in the longitudinal direction of the longitudinal fleece webs 24, 25 (which corresponds to the longitudinal direction of the corresponding cover layer 23, see FIG. 1B) the cutting device 5 is activated to cut the transverse fleece web 27 over its entire width to form a corresponding transverse fleece web segment, as shown in FIG. 5D.

Before cutting the transverse fleece web, the holding device 1-3 is activated again to clamp the transverse fleece web at a position which—in the running direction of the longitudinal fleece webs 24, 25—is after the position C of the cutting unit 5 and to avoid that the front edge of the remaining transverse fleece web material gets lost.

At this stage of the process, the free rear end of the transverse fleece web segment 27 is not yet attached to the longitudinal fleece webs 24, 25.

Figure 5E:
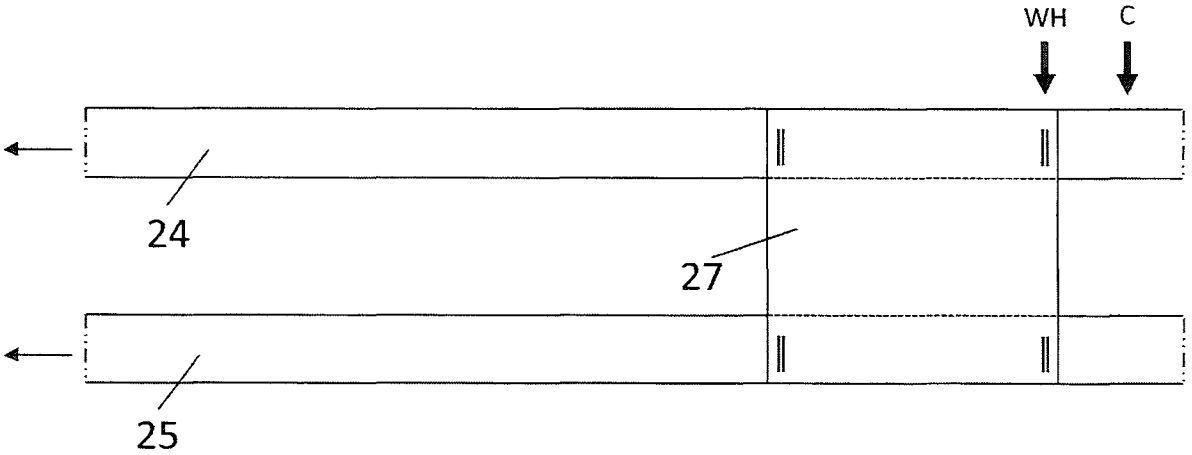

However, as shown in FIG. 5E, when the rear and of the transverse fleece web segment 27 reaches the position WH of the welding unit 4, the welding unit 4 is operated to weld the rear edge of the transverse fleece web segments 27 to both longitudinal fleece webs 24, 25.

Figure 5F:
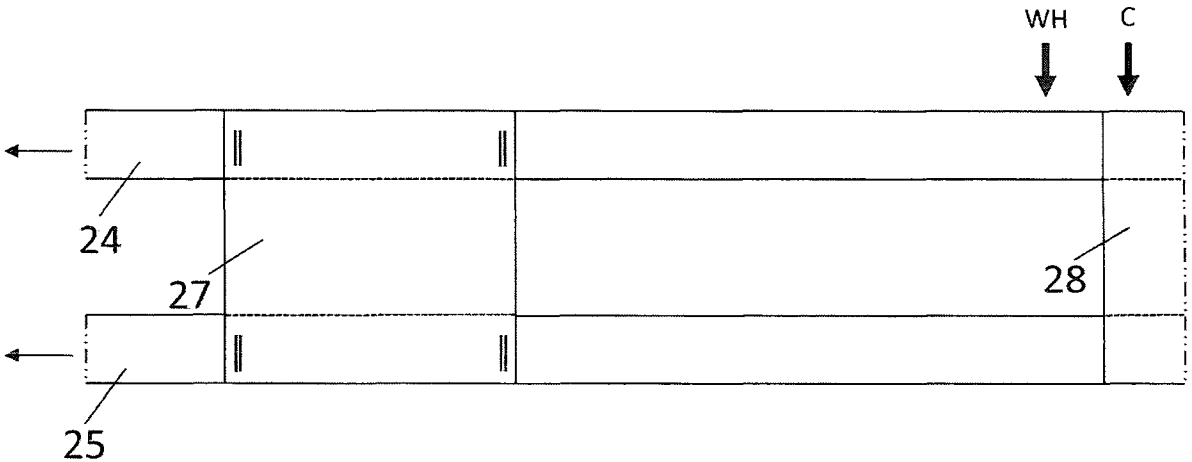

The entire process may then be repeated with the next transverse fleece web segment 28, as shown in FIG. 5F, the front edge of this next transverse fleece web segment 28 being positioned at the longitudinal fleece webs 24, 25 similar to the transverse fleece web segment 27 shown in FIG. 5A.

The position WH of the welding device 4 may be variable, so that the width of the welding unit 4 may be adjustable to process different fleece widths. Furthermore, the position C of the cutting device 5 may be variable so as to be able to cut transverse web segments having a variable width in the longitudinal direction of the longitudinal fleece webs 24, 25.

The transverse fleece web segments 26, 27 shown in FIG. 4B form together with the longitudinal fleece webs 24, 25 the semi-finished fleece product which is then cut by the cutting device 9 shown in FIG. 3 into the frame-like structure of the cover layer 23 of FIGS. 1A and 1B. The cutting device 9 cuts the longitudinal fleece webs 24, 25 at appropriate positions so as to obtain the structure of the cover layer 23 shown in FIGS. 1A and 1B.

Figure 6A:
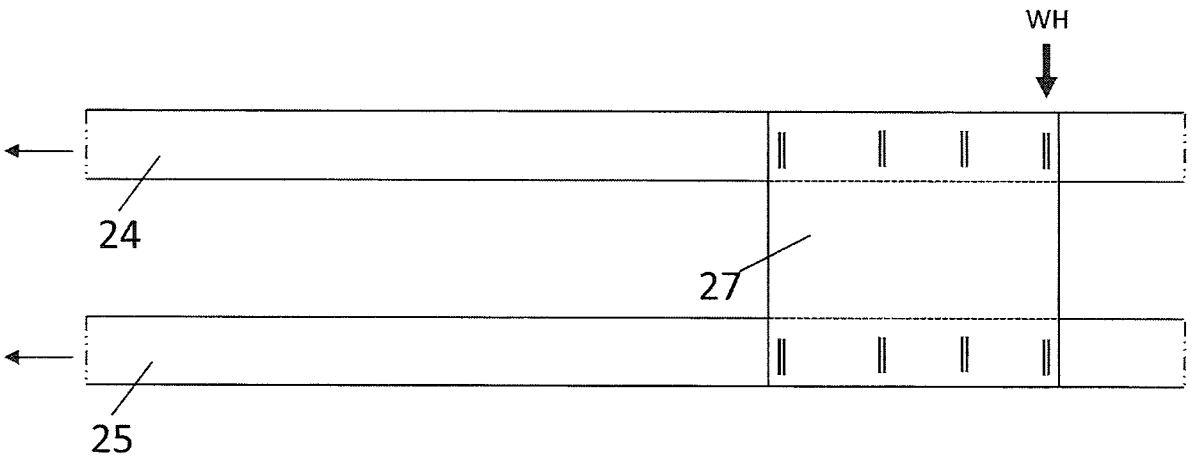
FIGS. 6A and 6B show a method of manufacturing a cover layer for an innerspring unit according to a further embodiment of the invention.
Figure 6B:
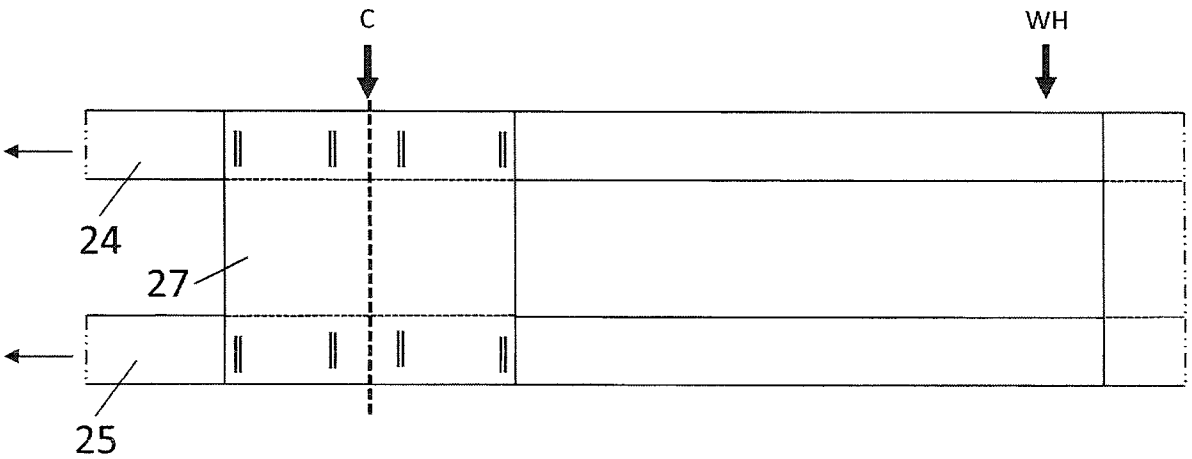

FIG. 6A and FIG. 6B show the attachment of the transverse fleece web 27 to the longitudinal fleece webs 24, 25 and the cutting according to a further embodiment.

As shown in FIG. 6A, the transverse fleece web 27 may be attachment to the longitudinal fleece webs 24, 25 at a plurality of positions, which in particular may be equally spaced.

As shown in FIG. 6B, the position C and the function of the cutting device may be such that the transverse fleece 27 is cut together with the longitudinal fleece webs 24, 25, as it is indicated by a dashed line in FIG. 6B.

What is claimed is:

1. A method of manufacturing a cover layer of a fleece material for an innerspring unit, comprising the steps of: supplying at least two longitudinal fleece webs, which extend substantially parallel in a longitudinal direction and are spaced from one another; repeatedly attaching a transverse fleece web, which extends between the longitudinal fleece webs in a direction substantially perpendicular to the longitudinal direction, to the longitudinal fleece webs, the transverse fleece web attached to the longitudinal fleece webs forming together with the longitudinal fleece webs a frame-like structure serving as the cover layer; wherein the step of repeatedly attaching the transverse fleece web is carried out while the longitudinal fleece webs are conveyed in the longitudinal direction by a respective conveyor; wherein the step of repeatedly attaching the transverse fleece web comprises the following steps repeatedly performed for each transverse fleece web of the frame-like structure: holding the transverse fleece web with a holding device and positioning the transverse fleece web with the holding device at the longitudinal fleece webs; attaching the transverse fleece web adjacent to a first transverse edge of the transverse fleece web to the longitudinal fleece webs; releasing the holding device so that the transverse fleece web attached to the longitudinal fleece webs is conveyed together with the longitudinal fleece webs; cutting the transverse fleece web to a desired width in the longitudinal direction to obtain a second transverse edge of the transverse fleece web; and attaching the transverse fleece web adjacent to the second transverse edge to the longitudinal fleece webs.

2. The method of claim 1, further comprising:

supplying the longitudinal fleece webs as endless longitudinal fleece webs, and repeatedly cutting the longitudinal fleece webs to repeatedly obtain the frame-like structure formed by two segments of the two longitudinal fleece webs and two successive transverse fleece webs attached to the two segments of the longitudinal fleece webs.

3. The method of claim 1, wherein the step of attaching the transverse fleece web comprises welding the transverse fleece web to each of the longitudinal fleece webs.

4. The method of claim 1, wherein the method is carried out as a fully automated process in an innerspring unit assembly machine.

5. The method of claim 1, wherein the cover layer of the fleece material is manufactured as the frame-like structure comprising a closed edge area where fleece material of the longitudinal fleece webs or fleece material of the transverse fleece web is present and a middle area surrounded by the edge area, where no fleece material is present.

6. The method of claim 1, further comprising activating the holding device to hold the transverse fleece web before the step of cutting.

7. The method of claim 6, further comprising supplying a fleece material and repeatedly cutting the fleece material to obtain the transverse fleece web.

8. A method of manufacturing an innerspring unit comprising a plurality of pocketed springs, comprising the steps of:

manufacturing a cover layer of a fleece material according to the method of claim 1; and attaching the cover layer to a surface of a body comprising the plurality of pocketed springs to form the innerspring unit.

9. The method of claim 8, further comprising:

manufacturing a first cover layer and a second cover layer; and attaching the first cover layer to a top surface of the body comprising the plurality of pocketed springs and the second cover layer to a bottom surface of the body comprising the plurality of pocketed springs.

10. The method of claim 8, wherein the step of manufacturing the cover layer is carried out at a first automated station of an innerspring unit assembly machine; and wherein the step of attaching the cover layer to the body comprising the plurality of pocketed springs is carried out at a second automated station of the innerspring unit assembly machine.

11. The method of claim 10, wherein the first automated station and the second automated station are located apart from one another; and wherein the method further comprises conveying the cover layer by means of a conveying device conveying the longitudinal fleece webs from the first station to the second station.

* * * * *